United States Patent [19]

Forrest

[11] 4,218,060

[45] Aug. 19, 1980

[54] FOOTBALL TRAINING DEVICE

[76] Inventor: Charles P. Forrest, 1306 St. Stephens Rd., Mobile, Ala. 36603

[21] Appl. No.: 947,635

[22] Filed: Oct. 2, 1978

Related U.S. Application Data

[63] Continuation-in-part of Ser. No. 844,177, Oct. 21, 1977, abandoned.

[51] Int. Cl.[2] ..... A63B 67/00

[52] U.S. Cl. ..... 273/55 R

[58] Field of Search ..... 273/55 R; 272/62, 63; 182/27, 117, 123, 125, 131, 141, 146, 224, 130, 145, 136, 17, 184, 178, 224, 225

[56] References Cited

U.S. PATENT DOCUMENTS

| | | | |
|---|---|---|---|
| 282,983 | 8/1883 | Haven | 182/145 |
| 1,195,976 | 8/1916 | Chesebro | 182/146 |
| 2,255,711 | 9/1941 | Noor | 273/55 R |
| 3,221,838 | 12/1965 | Brayton | 182/178 |
| 3,396,817 | 8/1968 | Perry | 182/179 |
| 3,480,110 | 11/1969 | Coleman | 182/184 |
| 3,578,323 | 5/1971 | Coleman | 273/55 R |
| 3,850,264 | 11/1974 | Salinas | 182/184 |

*Primary Examiner*—Richard C. Pinkham
*Assistant Examiner*—T. Brown
*Attorney, Agent, or Firm*—Kerkam, Stowell, Kondracki & Clarke

[57] ABSTRACT

A portable training device for teaching football linemen the proper technique for raising their bodies to blocking positions when firing off the line. The training device includes a plurality of inverted U-shape spaced upright members and an adjustable set of overhead bars connected between each two upright members. The overhead bars limit the height to which a moving player can raise his body without hitting his head.

4 Claims, 5 Drawing Figures

FOOTBALL TRAINING DEVICE

This is a continuation-in-part of application Ser. No. 844,177, filed Oct. 21, 1977.

BACKGROUND OF THE INVENTION

The present invention pertains to an improved football training device for teaching linemen the proper technique for raising their bodies to a semi-crouching blocking position while firing off the line, and more particularly to an adjustable training device which limits the height to which a lineman can raise his body while moving.

Modern football is a game of physical skills designed for performing specific tasks. One of these skills requires a lineman to maintain his body in a semi-crouching position while executing a proper block. Quite often a player fails to execute a proper block because he has not learned to slowly lift his body from a lineman's three point stance to a semi-crouching blocking position which gives him a lower center of gravity. With the proper knowledge of this physical skill a player will often fail to execute a proper block since he will not have the required leverage to block his opponent.

To acquire the needed physical skills a player must be taught to control the degree to which he lifts his body upward as he moves forward. At present there are only a few training devices which attempt to teach this physical skill, but they have not received wide acceptance because of their limitations such as non-adjustability and weight.

The only known pertinent prior art patent is U.S. Pat. No. 3,578,323, dated May 11, 1971, which shows a portable running chute comprising an elongated framework supported in horizontal position at its opposite ends by U-shaped upright stands. The height of the chute is adjustable by varying the length of the telescopic legs of the uprights. This device has drawbacks which limit its use. For example, adjustment is difficult since the whole chute must be partially lifted in order to make any adjustment. There are no means for joining a series of such chutes together to form a longer running chute, and the assembly does not lend itself readily to being transported.

SUMMARY OF THE INVENTION

The present invention provides a portable football training device of the type commonly called a running chute which is adapted to teach a player to slowly raise his body from a three-point stance to a semi-crouching position while moving comprising:

a. a plurality of inverted U-shape upright supporting members the legs of which rest on the ground;

b. a plurality of sets of horizontally extending overhead bars adjustably connected to the upright supporting members; and c. vertically adjustable elements connecting the overhead bars to the upright supporting means, whereby the bars may vary the height to which a player can raise his body as he moves through the chute.

It is therefore an object of this invention to provide a football training device for teaching a player to slowly raise his body using a chute comprising adjustable overhead bars.

Another object of this invention is to provide a football training device for teaching a player or a group of players to stay low in a semi-crouching position when running forward which can be adjusted to desired heights in two directions.

A further object of this invention is to provide a portable football training device for teaching interior linemen to stay low when firing off the line.

Still another object of this invention is to provide a football training device for teaching players proper body position for blocking which utilizes unique means for connecting successive sections of the device.

Other objects and advantages of this invention will become apparent from the following detailed description thereof and the accompanying drawings.

DESCRIPTION OF THE PREFERRED EMBODIMENT

Figure 1:
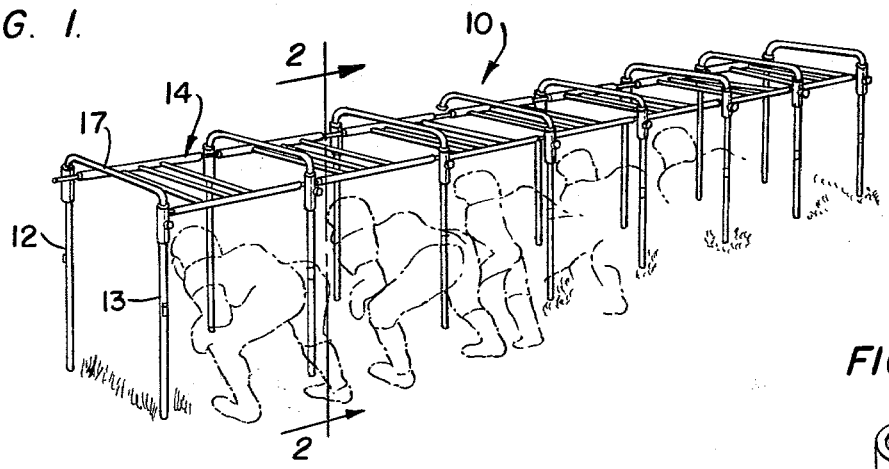
FIG. 1 is a perspective view of a football training device embodying the invention.
Figure 5:
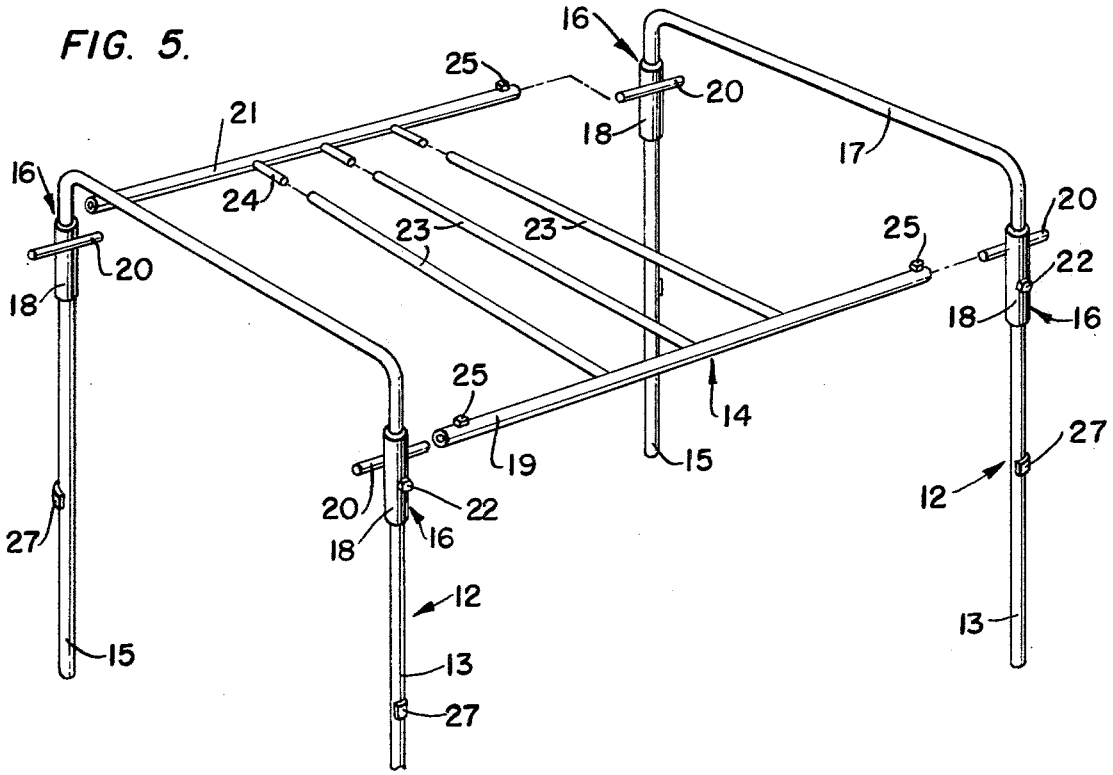
FIG. 5 is an exploded perspective view of one section of the device of FIG. 1.

Referring now to the drawings, and in particular to FIGS. 1 and 5, there is shown a football training device in the form of a running chute generally designated by the reference numeral 10. The chute 10 includes two or more inverted U-shape uprights 12 and one or more generally H-shape adjustable sets 14 of overhead bars. Each of inverted U-shape uprights 12 has a pair of vertical legs 13 and 15 joined together by a horizontal top bar 17. In the preferred embodiment, the uprights 12 are formed by making a double bend in a piece of metal tubing; however, it is contemplated that the legs 13 and 15 and the top bar 17 could be separately formed and welded or otherwise connected together.

Each of the H-shape sets 14 of overhead bars embodies a pair of parallel tubular side bars 19 and 21 connected by a plurality of cross bars 23 of variable length, the preferred arrangement being to provide three equally spaced tubular cross bar elements each welded at one end to the side bar 19 and telescoping of the other end with a pin 24 welded to side bar 21. With this arrangement, a player training to slowly raise his body to a semi-crouching position will contact one or more bars 23 if he lifts his body too soon. The side bars 19 and 21 are provided with set screws 25 threaded therein at each end.

Figure 3:
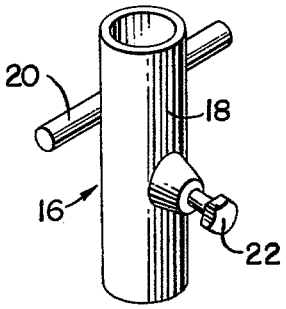
FIG. 3 is a perspective view of one of the connecting elements of device shown in FIGS. 1 and 2.

Completing the assembled device 10 are connectors 16, best seen in FIG. 3, each of which includes a vertical tubular element 18 and a horizontal cross bar element 20, welded to element 18. A locking screw 22 is threaded into the tubular element 18.

To assemble the device 10, a connector 16 is slipped over each of the tubular legs 13 and 15 of each U-shape upright 12 and the ends of the cross bars 20 are slipped into the adjacent ends of the tubular side bars 19 and 21 of a set 14 of overhead bars. The set screws 25 are then tightened to prevent the connections between the connectors 16 and the set 14 of overhead bars from coming loose. The other ends of the tubular side bars 19 and 21 are connected to an adjacent inverted U-shape upright 12 by repeating the above steps. If the training program requires the use of an elongated chute, as illustrated in FIG. 1, several U-shape uprights 12 and sets 14 of overhead bars can be joined by following the above steps.

To use the chute 10, each pair of uprights 12 are connected together in spaced relationship by a set 14 of overhead bars, as indicated in FIGS. 1 and 5. The angle of inclination of cross bars 23 may be adjusted by moving a pair of connectors 16 along the legs 13 of the uprights 12 relative to the connectors 16 on the legs 15 of said uprights. By thus moving the connectors 16 on legs 13 after loosening set screws 25, the side bar 19 of the overhead bars may be moved relative to side bar 21, thereby changing the inclination of cross bars 23.

The legs 13 and 15 of the uprights 12 have stops 27 to limit the lowest height of the overhead bars. Once the height and angle of inclination of the bars have been determined, usually based on the age and size of the players, locking screws 22 are tightened. It will be obvious that the inclination of cross bars 23 can be adjusted to any angle from 0° to about 45°, depending on the location of the stops 27.

Figure 2:
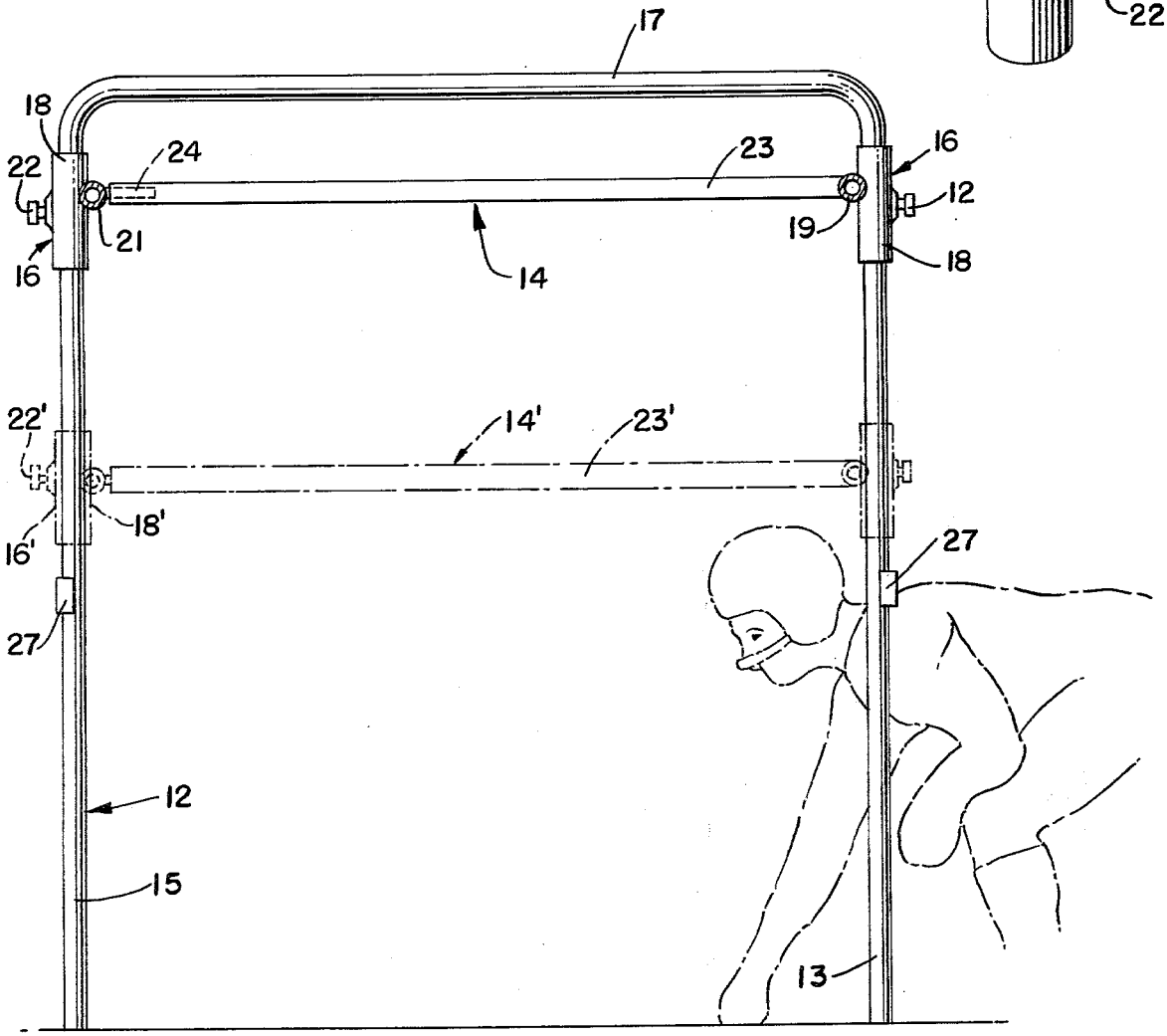
FIG. 2 is a fragmentary vertical sectional view of the football training device taken along the line 2—2 of FIG. 1.
Figure 4:
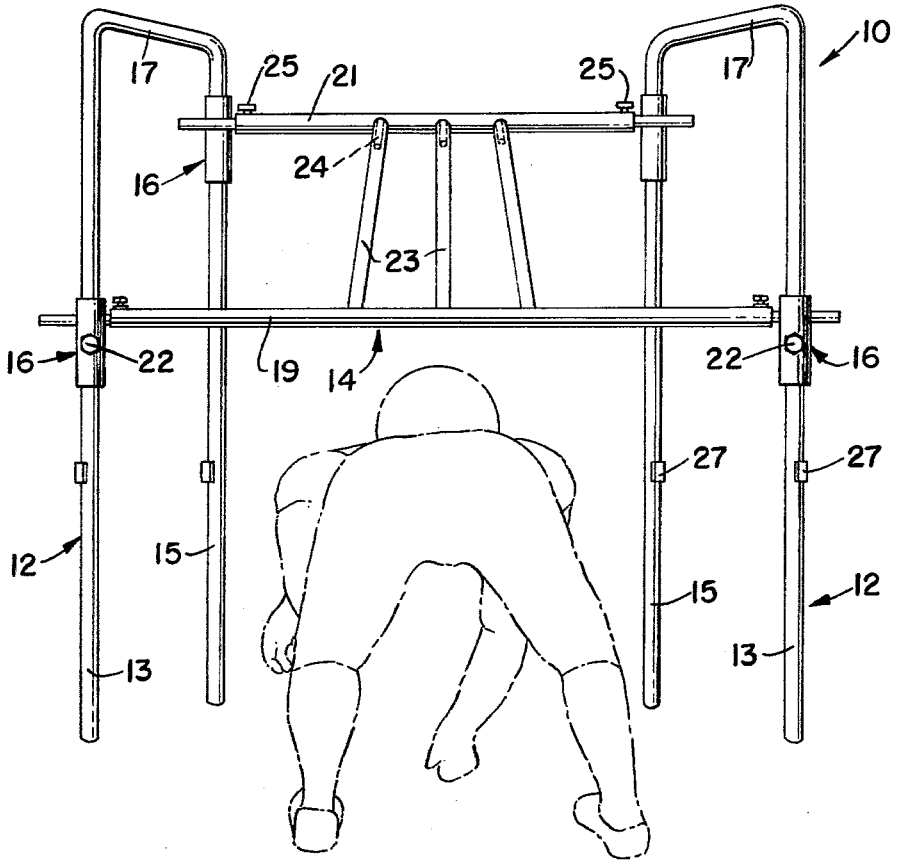
FIG. 4 is a perspective view taken from the side of one section of the device of FIG. 1 showing the overhead bars in a laterally inclined position.

If the training program requires the use of an elongated chute such as to accommodate a seven-man line, as illustrated in FIG. 1, the sets 14 of overhead bars may be positioned at different heights in the longitudinal direction of the chute by providing each upright 12 with two pairs of connectors 16 and 18 and adjusting each set of bars individually. FIG. 2 thus shows one set 14 of overhead bars in a raised position on an upright 12 and a second set 14′ in a lower position.

Although only one specific form of the football training device of the present invention has been described and illustrated in the accompanying drawings, it will be understood that various modifications and changes may be made by those skilled in the art without departing from the inventive concept. Reference should therefore be had to the appended claims for a definition of the scope of the invention.

I claim:

1. A football training device comprising a plurality of longitudinally spaced inverted U-shape supports, each support including a pair of vertical legs for engaging the ground and a horizontal cross member joining the upper ends of said pair of legs together, a plurality of substantially H-shape overhead frame units, means adjustably connecting each of said units to two adjacent U-shape supports at a predetermined height above a support surface, each of said overhead units including a pair of parallel substantially horizontal side bars connected by a plurality of transverse cross bars, each cross bar having means extending along its longitudinal axis to vary the effective length thereof said connecting means being vertically movable on said legs of said inverted U-shape supports and connecting each end of said side bars to a said leg of said supports whereby said cross bars may be positioned either parallel or inclined to the ground.

2. A football training device as claimed in claim 1 wherein each of said connecting means comprises a tubular element vertically slidable on each or said legs of said supports, and means on each of said tubular elements for fixing said tubular element in a plurality of positions on each of said legs of said support in vertically adjusted positions.

3. A football training device comprising first and second upright supporting members each including a pair of parallel vertical legs joined at their upper ends by a horizontal cross member, and a set of overhead frame units adjustably connected to said first and second upright supporting members to maintain said members in a longitudinally spaced relationship and form a running chute, said overhead frame units including a pair of parallel side bars and a plurality of parallel cross bars, said cross bars having means on at least one end thereof to vary the effective length thereof, whereby the said overhead frame units limit the height to which a person running thereunder and through the chute can raise his head.

4. A football training device as claimed in claim 3 wherein the upright supporting members and the set of overhead bars are connected to one another by connecting members slidably mounted on the vertical legs of said supporting members, said slidable connecting members and said means to vary the effective length being adapted to allow adjustment of the inclination of said overhead frame units laterally of the chute.

* * * * *